United States Patent [19]

Floyd

[11] Patent Number: 4,562,948

[45] Date of Patent: Jan. 7, 1986

[54] NAIL DRIVING TOOL

[76] Inventor: Robert M. Floyd, 702 Temple Ave., Nashville, Tenn. 37215

[21] Appl. No.: 671,423

[22] Filed: Nov. 14, 1984

[51] Int. Cl.[4] ..... B25C 7/00; B25C 5/02

[52] U.S. Cl. ..... 227/147; 227/113; 227/156

[58] Field of Search ..... 227/113, 147, 156

[56] References Cited

U.S. PATENT DOCUMENTS

| | | | |
|---|---|---|---|
| 1,776,646 | 9/1930 | Wilson | 227/147 |
| 2,666,201 | 1/1954 | Van Orden | 227/147 |
| 3,854,536 | 12/1974 | Hallock, Jr. | 227/113 X |
| 3,979,040 | 9/1976 | Denin | 227/113 |
| 4,299,021 | 11/1981 | Williams | 227/156 X |

*Primary Examiner*—Paul A. Bell
*Assistant Examiner*—Taylor J. Ross
*Attorney, Agent, or Firm*—Harrington A. Lackey

[57] ABSTRACT

A driving tool for an elongated fastener of ferro-magnetic material, including an elongated hollow tubular body reciprocably receiving a driving rod having an impact end and a drive end. The drive end is characterized by an internal cavity receiving an Indalloy permanent magnet, the open end of the cavity being closed by a magnetic head, or pole piece, in such a manner that the axial impact forces imparted to the drive rod are transmitted substantially entirely to the magnetic head and not through the magnet. The Indalloy magnet is utilized within the drive end of the drive rod so that its magnetism will be retained, even if fragmented.

6 Claims, 4 Drawing Figures

NAIL DRIVING TOOL

BACKGROUND OF THE INVENTION

This invention relates to a fastener driving tool, and more particularly to a driving tool having a magnet for supporting a fastener of ferro-magnetic material.

Fastener driving tools having elongated tubular bodies receiving the fastener and a reciprocable impact rod, are well known in the art, as shown in the following U.S. Pat. Nos.

| | | |
|---|---|---|
| 541,038 | Clark | Jun. 11, 1895 |
| 1,127,838 | Willers | Feb. 9, 1915 |
| 1,575,582 | Joy | Mar. 2, 1926 |
| 2,666,201 | Van Orden | Jan. 19, 1954 |
| 3,163,865 | Zetzer et al | Jan. 5, 1965 |
| 3,324,542 | Hilti | Jun. 13, 1967 |
| 3,391,842 | Mathes | Jul. 9, 1968 |
| 3,979,040 | Denin | Sep. 7, 1976 |
| 4,065,045 | Pray | Dec. 27, 1977 |
| 4,299,021 | Williams | Nov. 10, 1981 |

Furthermore, of the above cited patents, the following patents disclose impact fastener driver tools having magnetic heads for holding a fastener of ferro-magnetic material while it is being driven into a work surface:

| | | |
|---|---|---|
| 541,038 | Clark | Jun. 11, 1895 |
| 1,127,838 | Willers | Feb. 9, 1915 |
| 2,666,201 | Van Orden | Jan. 19, 1954 |
| 3,979,040 | Denin | Sep. 7, 1976 |
| 4,299,021 | Williams | Nov. 19, 1981 |

The above Van Orden U.S. Pat. No. 2,666,201 discloses an impact-type nail driving tool in which the drive end of the drive shaft includes an elongated cavity containing a permanent magnet within a sleeve, with the cavity and sleeve being closed by a metallic retainer core.

However, none of the above patents disclose an impact-type nail driving tool having a magnetic head in which the magnet is received within an internal cavity in the drive end of the drive rod so that substantially all of the forces from the impact upon the drive rod are transmitted to the magnetic head supporting the fastener, and not through the magnet itself.

Moreover, none of the above patents disclose an impact-type magnetic nail driving tool in which the permanent magnet is made of Indalloy or other comparable material.

SUMMARY OF THE INVENTION

It is therefore an object of this invention to provide a driving tool of the impact-type, for a steel nail or other fastener of ferro-magnetic material, including an elongated tubular body reciprocably receiving a drive rod having a cavity in its drive end receiving a magnet, in which the impact forces applied to the drive rod are transmitted directly to the fastener received in the tubular body without passing through the magnet itself.

Another object of this invention is to provide a magnetic nail driving tool of the impact-type in which the permanent magnet is Indalloy, or other comparable magnetic material, which is capable of retaining its magnetism even if fragmented.

Another object of this invention is to provide a fastener driving tool of the impact-type having a non-magnetic drive rod including a cavity within the drive end of the drive rod receiving an Indalloy permanent magnet and a magnetic head adapted to close the open end of the cavity, to hold a fastener or nail of ferro-magnetic material in operative driving position, and to receive substantially the entire axial forces of impact transmitted through the drive rod, without transmittal through the magnet.

DESCRIPTION OF THE PREFERRED EMBODIMENTS

Figure 1:
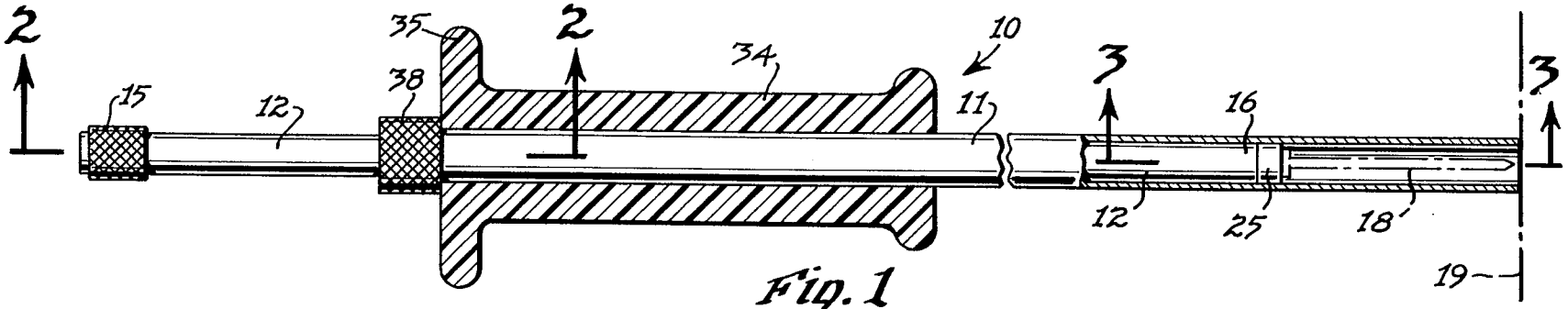
FIG. 1 is a side elevation of the nail driving tool made in accordance with this invention, with portions broken away and portions in section, illustrating the tool supporting a nail in an inoperative position preparatory to driving.

Referring now to the drawings in more detail, the nail driving tool 10 made in accordance with this invention includes an elongated tubular body 11 made of non-magnetic material, such as stainless steel, within which is slideably or reciprocably received an elongated drive rod 12, also of a non-magnetic material, such as stainless steel. The drive rod 12 is slightly longer than the tubular body 11.

The tubular body 11 is cylindrical and has an inner cylindrical surface only slightly greater in diameter than the outer cylindrical surface of the drive rod 12, so that the drive rod 12 has a slideable fit within the tubular body 11.

Figure 2:
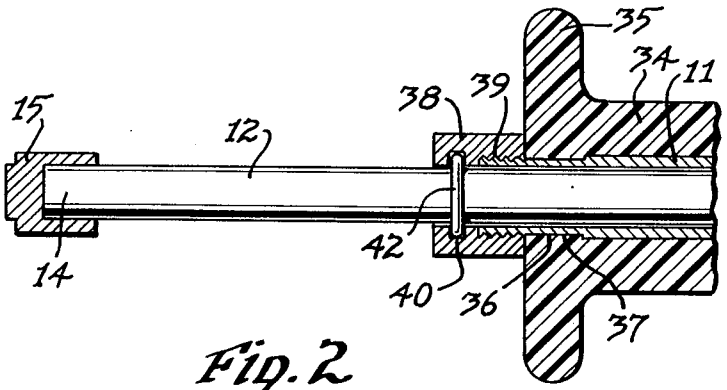
FIG. 2 is an enlarged fragmentary section taken along the line 2—2 of FIG. 1.

The rear end of the drive rod 12 constitutes the strike end 14, adapted to be struck axially by a heavy tool, such as a hammer, to force the drive rod 12 longitudinally and coaxially through the tubular body 11. The strike end 14, as best illustrated in FIG. 2 is preferably tightly fitted within a cylindrical strike cap 15. The strike cap 15 is preferably made of a harder steel than the drive rod 12 to better absorb the blows of the hammer, not shown, against the strike end 14, and also to protect the strike end 14 from undue wear, or damage.

Figure 4:
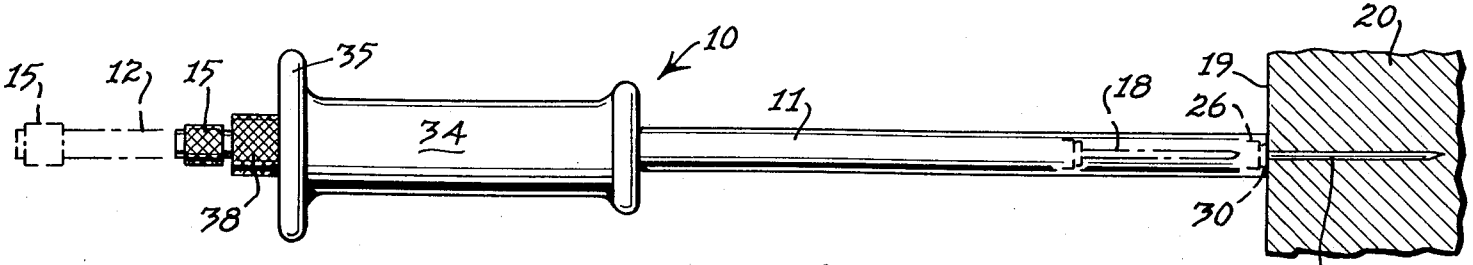
FIG. 4 is a side elevation of the driving tool, on a reduced scale, showing the drive rod and nail in a driven position, in solid lines, and illustrating the drive rod in its inoperative retracted position, in phantom.

The front or drive end portion 16 of the drive rod 12 is provided with magnetic means for holding in place a fastener of ferro-magnetic material, such as the steel nail 18, confined within the corresponding front end portion of the tubular body 11, preparatory for driving into a work surface 19 of a work-piece, such as the wall 20 (FIG. 4).

This magnetizing means in the drive end portion 16 of the rod 12 is preferably in the form of an elongated cylindrical permanent magnet 22, such as "Indalloy", and specifically "Ind. Gen. Indalloy". The Indalloy magnet 22 is received within a cylindrical cavity 23 formed axially through the front or drive end portion 16 of the drive rod 12. This cavity 23 opens through the front end 16 of the rod 12 and is longer than the permanent magnet 22. The elongated cylindrical cavity 23 is preferably coaxial with the drive rod 12 and has an open front end 24.

A driver head member 25 is provided for closing the open end 24 and for completely encapsulating the permanent magnet 22 within the cavity 23, as well as for transmitting the magnetic force of the magnet 22 to the head of the nail 18.

The driver head member 25 includes an enlarged cylindrical ferro-magnetic head 26 having a diameter approximately equal the outer diameter of the drive rod 12 and substantially greater than the diameter or transverse dimension of the cavity 23. Projecting from the rear end of the drive head 26 is a stem 27 of reduced cross-section. The stem 27 is preferably cylindrical, but in any event has the same cross-sectional shape and substantially the same transverse dimension as the cavity 23, to permit a tight slip-fit of the stem 27 within the cavity 23, as best disclosed in FIG. 3.

The intersection of the stem 27 with the rear face of the head 26 forms an annular or circular ledge or flange 28 substantially planar, normal to the longitudinal axis of the drive rod 12, and adapted to fit flush against the front end face of the drive end portion 16, in operative position.

Figure 3:
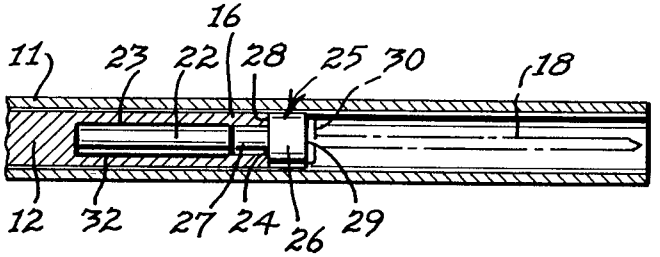
FIG. 3 is an enlarged fragmentary section taken along the line 3—3 of FIG. 1.

When the stem 27 of the driver head member 25 is fitted within the cavity 23 in its operative position as disclosed in FIG. 3, the length of the cavity 23 is slightly greater than the combined length of the magnet 22 and the stem 27. Thus, any impact force received on the strike end 14 of the rod 12 will be transmitted through the length of the drive rod 12 and its drive end portion 16 directly to the drive head 26, without any substantial impact transmission through the magnet 22.

In a preferred form of the invention, the magnet 22 is secured within the cavity 23 by an epoxy adhesive 32, which not only secures the magnet 22 within the cavity 23, but also provides an insulation cushioning layer as an additional protection against any impact forces transmitted through the drive rod 12.

The front drive face 29 of the drive head 26, is preferably planar and normal to the longitudinal axis of the drive rod 12 to fit flush against the head 30 of the nail 18 to magnetically hold the nail 18 in its position preparatory to driving, as disclosed in FIGS. 1 and 3, and in phantom in FIG. 4.

Fitted in a fixed position about the rear end portion of the tubular body 11 is an elongated tubular handle or hand gripping member 34. The end of the handle 34 adjacent the strike end portion 14 of the rod 12 is provided with an enlarged annular flange or strike shield 35.

In a preferred form of the invention, the upper or strike end portion of the tubular body 11 has an external annular recess 36 for receiving a correspondingly shaped annular portion 37 of the rear end portion of the handle 34, to prevent the handle 34 from being driven forward upon impact of the drive rod 12.

An annular rebound suppressor cap 38 is fixed to the rear end portion of the tubular body 11, and preferably engages the rear face of the strike shield 35. The rebound suppressor cap 38 may be fixed to the tubular body 11 by the threads 39 and fitted against the rear face of the strike shield 35 to secure the handle 34 upon the tubular body 11 against axial movement in either direction.

The primary function of the rebound suppressor cap 38 is to absorb the impact of the strike cap 15, any time the strike cap 15 might engage the suppressor cap 38.

Preferably, an interior annular recess 40 is formed within the suppressor cap 38 to receive an annular O-ring 42 in snug, but slideable, engagement with the exterior surface of the drive rod 12. Both the rear face of the suppressor cap 38 and the annular O-ring 42 tend to resist the rebound of the strike cap 15 and the drive rod 12 after a forward driven movement. The O-ring 42 also tends to hold the drive rod 12 against inadvertent slideable movement when the drive rod 12 is placed in any desired position relative to the tubular body 11. The O-ring 42 may be made of cast polyurethane, rubber or other resilient material having a high co-efficient of friction.

In the operation of the driving tool 10, the drive rod 12 is grasped at its rear or strike end by the hand of the operator of the tool and drawn rearward to cause the drive end 16 of the rod 12 and the driver head member 25 to retract within the front end portion of the tubular body 11, far enough to receive and retain a fastener, such as the nail 18, as illustrated in FIGS. 1 and 3. The nail 18 is placed head first into the open front end of the tubular body 11 until the head 30 is magnetically engaging the front face 29 of the drive head 26. The driving tool 10 is then loaded and prepared for driving a nail 18 into any desired work piece or pieces.

The front end of the tubular body 11 is then placed against the work surface 19 into which it is desired to drive the nail 18. After the tubular body 11 is in its driving position, as disclosed in FIGS. 1 and 4, the operator holds the tool 10 in its driving position by grasping the handle 34 with one hand. Then with the other hand grasping a hammer, not shown, the operator swings the hammer forcefully and axially against the strike cap 15 to create an impact great enough to drive the driving rod 12 rapidly forward through the tubular body 11 to force the nail 18 into the work surface 19. The blows of the hammer against the strike cap 15 are continued until the nail 18 has been driven as far as desired into the work-piece 20, such as when the nail head 30 is flush against the work surface 19, as disclosed in dashed lines in FIG. 4.

While the driving rod 12 is being driven forward, the O-ring 42 permits the forward forceful movement of the driving rod 12 through the tubular body 11, but prevents the driving rod 12 from rebounding rearward.

If the driving operation continues until the strike cap 15 engages the suppressor cap 38, the suppressor cap 38 tends to minimize or reduce the rebound action of the strike cap 15.

Both the suppressor cap 38 and the annular strike shield 35 tend to protect the hand of the tool operator grasping the handle 34 during the driving operation.

Because substantially all of the driving forces are transmitted axially through the driving rod 12 to the drive head 26, the magnet 22 will not likely be damaged nor have its magnetic effect reduced by fracture or stress.

Furthermore, a preferred form of permanent magnet 22 is the previously described Indalloy magnet, which retains its magnetism, even if fractured or fragmented by the impact forces transmitted through the drive rod 12.

The nail driving tool 10 made in accordance with this invention is thus designed for a long operating life, including an enduring magnetic attraction between the drive end 16 of the driving rod 12 and the magnetically attracted fastener, such as the steel nail 18.

The nail driving tool 10 made in accordance with this invention facilitates the nailing or fastening of objects in remotely accessible areas, such as in the hanging of cabinets between joists, the attachment of articles adjacent fragile objects, or the overhead fastening of objects such as hang straps for pipes or ducts.

The nail driving tool 10 effectively extends the reach of the operator in any direction up, down, or lateral, desired by the operator.

The confinement of the nail 18 within the open front end of the tubular body 11 while the drive rod 12 is retracted tends to hold the nail 18 in its straight position while it is driven into the work surface 19 to prevent bending of the nail 18.

The especially designed handle 34 with its strike shield 35 and compressor cap 38 provides a substantial protection for the operator's hand during the driving operation. In a preferred form of the invention, the handle 34 is made of an electrically insulating material to prevent electrical shock to the operator in the event the tool encounters live un-insulated electrical wires.

What is claimed is:

1. A driving tool for an elongated fastener of ferromagnetic material comprising;

(a) an elongated, non-magnetic, tubular body having front and rear end portions, and a uniform bore, (b) a hand gripping member fixed on said tubular body adjacent said rear end portion, (c) an enlogated, non-magnetic drive rod, longer than, and telescopingly received in said bore, said rod having a rear strike end and a front drive end, (d) an elongated cavity within said drive rod and opening through said drive end, (e) an elongated Indalloy permanent magnet received within said cavity, said magnet having a length less than the length of said cavity, (f) a driver head member having an enlarged ferromagnetic head of a transverse dimension greater than said cavity and not greater than said drive rod, (g) means securing said head member against said front drive end to close said cavity, so that the axial forces produced by an impact upon said strike end are transmitted totally through said drive rod to said head, without the transmission of any substantial forces through said magnet.

2. The invention according to claim 1 in which said means securing said head member against said front drive end comprises a stem of reduced cross-section projecting from said head and received within said cavity.

3. The invention according to claim 2 in which the intersection of said stem and said head defines an annular flange normal to the longitudinal axis of said drive rod, the total length of said magnet and said stem being less than the length of said cavity, whereby said drive end engages said annular flange.

4. The invention according to claim 1 further comprising a strike shield projecting transversely from the periphery of said hand gripping member and adjacent said rear end portion of said tubular body.

5. The invention according to claim 1 further comprising a rebound suppressor cap member fitted around the rear end portion of said tubular body and a striker cap ember fitted over the strike end of said drive rod, said suppressor cap member being sufficiently resilient to minimize the reaction forces in said drive rod when said striker cap engages said suppressor cap upon impact.

6. The invention according to claim 5 in which said suppressor cap member further comprises an O-ring fitting in snug engagement with a portion of said drive rod extending through said suppressor cap member.

* * * * *